US006733374B2

(12) United States Patent
Gegenheimer et al.

(10) Patent No.: US 6,733,374 B2
(45) Date of Patent: May 11, 2004

(54) GRINDING MACHINE

(75) Inventors: Helmut Gegenheimer, Keltern (DE); Helmut Lutz, Remchingen (DE)

(73) Assignee: OTEC Prazisionsfinish GmbH, Straubenhardt-Feldrennach (DE)

( * ) Notice: Subject to any disclaimer, the term of this patent is extended or adjusted under 35 U.S.C. 154(b) by 0 days.

(21) Appl. No.: 10/182,665

(22) PCT Filed: Feb. 23, 2001

(86) PCT No.: PCT/EP01/02068

§ 371 (c)(1),
(2), (4) Date: Jul. 31, 2002

(87) PCT Pub. No.: WO01/64394

PCT Pub. Date: Sep. 7, 2001

(65) Prior Publication Data

US 2003/0027509 A1 Feb. 6, 2003

(30) Foreign Application Priority Data

| | | |
|---|---|---|
| Feb. 29, 2000 | (WO) | PCT/EP00/01675 |
| Mar. 23, 2000 | (DE) | 200 05 360 U |
| May 26, 2000 | (DE) | 200 09 539 U |

(51) Int. Cl.[7] ..... B24B 31/02

(52) U.S. Cl. ..... 451/326; 451/327; 451/328; 451/329; 451/330

(58) Field of Search ..... 451/326–330, 451/32, 35, 74, 103, 104, 106, 109, 110, 111, 112, 113, 118

(56) References Cited

U.S. PATENT DOCUMENTS

| | | | | |
|---|---|---|---|---|
| 4,484,372 A | * | 11/1984 | Patzold et al. | 15/42 |
| 4,850,151 A | * | 7/1989 | Ditscherlein | 451/327 |
| 5,279,074 A | | 1/1994 | Davidson | |
| 5,823,861 A | * | 10/1998 | Kobayashi et al. | 451/326 |
| 6,080,052 A | * | 6/2000 | Renter et al. | 451/326 |
| 6,296,556 B1 | * | 10/2001 | Gegenheimer | 451/326 |
| 6,379,233 B1 | * | 4/2002 | Kobayashi et al. | 451/326 |

FOREIGN PATENT DOCUMENTS

| | | |
|---|---|---|
| DE | 19728931 | 1/1999 |
| EP | 232532 | 8/1987 |
| EP | 649705 | 4/1995 |
| EP | 791430 | 8/1997 |
| GB | 1446414 | 8/1976 |

* cited by examiner

*Primary Examiner*—George Nguyen
(74) *Attorney, Agent, or Firm*—Antonelli, Terry, Stout & Kraus, LLP

(57) ABSTRACT

The invention proposes a device for grinding or polishing workpieces by means of an abrasive, having a container and a rotary disk located therein and rotatable relative thereto, in which the rotary disk is made from elastic material, is provided with an upwardly directed rim and said rim has a finite spacing from the adjacent inner wall of the container.

27 Claims, 5 Drawing Sheets

GRINDING MACHINE

BACKGROUND OF THE INVENTION

Device for grinding or polishing workpieces by means of an abrasive, having a container (2) and with a rotary disk (3) located therein and rotatable relative thereto.

Such devices are known in the form of centrifugal sliding grinding machines, which comprise a two-part container with a shell-shaped, rotatable container lower part forming a bottom and a stationary, cylindrical container upper part.

Such grinding machines are used for the surface machining of grinding articles, e.g. smaller parts and workpieces, which are moved in the container together with the abrasive objects and optionally a liquid process medium. If the lower part is rotated, the workpieces to be treated are moved outwards on the disk until they encounter the inner wall of the container, where they are decelerated. A rotary workpiece movement occurs as a result of the subsequently supplied workpieces and this leads to an intense grinding or polishing action.

It is a disadvantage of such centrifugal sliding grinding machines that the sealing of the annular clearance and the guidance of the faces bounding the same give rise to considerable problems, which can only be overcome with considerable effort and corresponding costs.

There is a danger that the upper and lower parts, particularly the lower part, will be very greatly heated as a result of friction, if parts of the grinding article and/or additionally added abrasive objects during operation enter the gap between the container bottom and the rotary disk. This leads on the one hand to an only relatively short regrind life of the grinding machine and on the other the latter must be frequently switched off during the machining of grinding articles in order to prevent overheating both of the grinding machine and also the grinding or polishing article.

DE 197 28 931 A1 discloses a liquid grinding machine for the liquid working of workpieces. A substantially planar elastic disk is provided, whose radial extension exceeds the radial extension of the surrounding container, so that on inserting the disk in the container its flexible rim or edge is directed upwards and firmly engages on the container wall, the compressive force being reinforced by the centrifugal force during rotation of the disk. The liquid necessary for wet working is introduced into the container below the disk and under the pressure overcoming the aforementioned application forces is forced between the disk rim and container wall into the machining chamber. As a result of considerable technical and constructional effort and expenditure, a penetration of grinding material into the area below the rotary disk is prevented, but in this form is only possible with wet machining.

SUMMARY OF THE INVENTION

The problem of the invention is to provide a simply constructed, inexpensive device for polishing and grinding, whilst avoiding the aforementioned disadvantages, which in the case of limited wear susceptibility functions reliably and has a long regrind life.

According to the invention, in the case of a device of the aforementioned type, this problem is solved in that the rotary disk has an upwardly drawn, elastic disk rim and that the disk rim has a finite spacing from the adjacent inner wall of the container.

The finite spacing or gap, unlike in the case of DE 197 28 931 A1, is constructionally determined by a radial minimum dimension of the rotary disk with respect to the radial inside dimensions of the container and consequently also exists in the inoperative state, particularly without the action of any external forces, such as occur in the prior art as a result of the liquid forced through between the disk and the container wall. Thus, the elastic and in particular flexible disk rim is not in contact with the container wall when the device is in the inoperative state when the disk rim is not burdened by introduced material. The invention deliberately takes into account the fact that the abrasive particles can pass between the disk rim and the container wall, as well as between the disk bottom and the container bottom. This is counteracted by the centrifugal force exerted on such particles by the rotation of the rotary disk and this leads to the particles being directed radially outwards below the disk bottom, which is aided by the elastic and preferably flexible underside of the disk bottom. As a result of this and due to the elastic, flexible design of the disk rim, abrasive particles located between the latter and the container wall are returned to the grinding chamber. A dynamic equilibrium of the material flow occurs and there is always a certain mount of abrasive particles, which form an abrasion-reducing lubricant between the disk rim and the container wall.

According to a preferred development, the disk rim tapers in pointed manner towards its free circumferential edge. As a result the disk rim can be given a high flexibility, particularly in its outer, free edge region.

According to a highly preferred development, the disk rim is inclined outwards and has an inclination to the horizontal of less than 90°, preferably between 30 and 70°. The (inner) opening or aperture angle of the disk rim to the horizontal is consequently between 150 and 110°.

The size of the gap or the finite spacing of the disk rim from the container wall is preferably between 2 and 10% of the disk diameter and therefore, for conventional disk diameters of 15 to 40 cm, generally between 0.4 and 2 mm, preferably between 0.7 and 1 mm.

According to other preferred developments, the bottom of the rotary disk substantially has a constant thickness, the disk rim having a smaller thickness than the disk bottom or the outer circumference (towards the raised disk rim) of the disk bottom tapers.

It can be provided that the disk bottom thickness is between approximately 2 and 8% of its diameter and that the rotary disk thickness is between approximately 5 and 10 mm.

The disk is also spaced from the container bottom. In a preferred development, the vertical spacing is between 1 and 2 mm. The gap width can in particular also be variable, so as to adapt the gap to the granular material used. The adjustability of the gap can be made possible by random known means, e.g. by a washer or the like placed between the container bottom and the disk and as a result a shaft passing through the container bottom for the mounting of the flexible disk can be vertically adjustable and fixed at a random height. Alternatively the container can be vertically adjustable with respect to the disk and can be fixed in a desired height. According to a highly preferred development, the size of the gap between the disk rim and the container wall is smaller than the axial spacing from the disk to the container bottom. This ensures that it is only possible for particles to pass below the rotary disk which are much smaller than the spacing of the rotary disk bottom to the container underside.

According to a highly preferred development, in the transition area from the container bottom to the container wall, an increased spacing is formed with respect to the rotary disk and in particular the circumference of the disk bottom and which is in particular formed by a notch in the passage of the container wall towards the container bottom. This ensures that the rotary disk bottom, which is radially relatively firm, does not strike against the lower area of the container wall as a result of thermal expansion. In the container wall notch it is possible for abrasive material to collect and this consequently guides the returned, loose abrasive particles. As a result of its elasticity and the abrasive particles acting as a lubricant there, a radial thermal expansion in the vicinity of the disk rim is not critical.

It has been found that there is no increased heating under friction and in particular no fusing takes place.

Besides the choice of a flexible material, this is also helped by the shape of the circumferential rim, in that the latter is slender in cross-section and pointed from the bottom area of the disk towards the free edge or lip, so that assistance is also provided by the high lip flexibility.

According to a further development of the invention, the rotary disk is made from plastic, particularly polyurethane. In a preferred development, at least the inside of the container and preferably the entire container is made from plastic, preferably polyamide 6 (PA6) or polyamide 66, the Shore hardnesses of the materials preferably being between 50 and 95°.

It has been found that such polyamides, particularly based on polycaprolactam, constitute an optimum material for the container wall. In the case of standard abrasive materials or abrasives, the said material is not subject to any abrasion and wear. In addition, a fusing with the rotary disk when suitable materials are used for the latter, once again polyurethane, is reliably prevented. As a result of the use of PA6, the self-cleaning effect of such abrasive parts which pass into the gap and immediately are moved out again, is significantly improved compared with a PU-PU pairing.

The invention also relates to a grinding system with a device according to the invention for the polishing and grinding of workpieces and with an abrasive having organic grains, the latter more particularly consisting of natural, organic material, such as walnut or coconut shell, wood, cherry stones, etc. or the abrasive grains consist of synthetic-organic material, particularly plastic. The abrasive is preferably a composite abrasive with a central, organic material grain, which is surrounded by a binder layer containing polishing particles. In a preferred development, the polishing grain composite has a central walnut grain, which is enclosed by a fat or wax layer, in which are incorporated polishing grains, particularly of aluminium oxide. This abrasive has proved to be of an optimum nature when used in a grinding machine with a polyamide 6 casing and in particular also with a polyurethane disk, in order to on the one hand obtain good grinding results and on the other to prevent damage of the grinding article or workpiece and also the container wall and grinding disk, both through the otherwise occurring jamming and blocking of the drive. The abrasive grain size can be between 50 and 500.

Another preferred development is characterized in that below the disk in the bottom of the container is provided a closable outlet.

According to another highly preferred development, a drive axis of the grinding disk passes in liquid-tight manner through the container bottom.

According to other developments, on the container and below the disk is provided a rotary drive for the latter, whereby the axes of the disk and the rotary drive are aligned.

This preferred development makes it possible to design a grinding machine in a simple and inexpensive manner. This is helped by the fact that the disk is connected in bearing-free, non-rotary manner to the driven shaft of the rotary drive. Through this preferred solution there is no need to provide a separate bearing for the driving shaft of the rotary disk in addition to the bearing for the driven shaft of the rotary disk, where the latter may be a driving motor or a geared motor with integrated motor and integrated gear. According to a preferred development, the disk is connected by means of a coupling to the driven shaft of the rotary drive and in particular the coupling has aligned bores. which carry the driven shaft of the rotary drive and a centring pin for the disk. The coupling and the driven shaft are connected in non-rotary manner by a radial clamping bolt. The rotary disk and coupling are interconnected in non-rotary manner by means of screws. There is a dust-tight and/or liquid-tight passage of the disk drive through the container bottom and the coupling is in particular held firmly in the containers by retaining rings, so that an optimum sealing action is obtained.

According to other developments of the invention, the rotary drive is held in a foot or base part and firmly connected thereto by screws and the fastening screws for the rotary drive are oriented parallel to the axis.

The casing is preferably in one piece and in particular the casing and/or container is made from plastic. As a result the grinding machine according to the invention can be manufactured economically and therefore inexpensively. This is helped by the fact that the gear is placed below the disk. In an alternative development, the drive is constructed as a geared motor with an integrated drive and then in particular the motor is vertically oriented with its axis and a driving shaft passes out at the lower end of the motor.

As a result of the construction of the device or grinding unit according to the invention, a machine can be provided with several grinding units at limited cost, so as to e.g. permit the rational machining of heavier and/or shock-sensitive workpieces, which do not allow a common machining of several workpieces in a single container. In fact, a large number of units can be provided, e.g. more than 30. The disks of the individual containers can either be separately driven or the grinding machine has a common drive for all the units. In the latter case the disks of the units in each case located on one shaft can be connected by coupling elements, such as meshing gear wheels, V-belts, etc., to the central drive and the disks of individual containers can preferably be separated uncoupled from the central drive, so that during the grinding of workpieces in certain containers of the grinding machine, the other containers can e.g. be cleaned or emptied and then again filled with workpieces. A grinding machine according to the invention can in particular be used for the dry polishing of jewellery, dental parts, etc.

BRIEF DESCRIPTION OF THE DRAWINGS

Further advantages and features of the invention can be gathered from the claims and the following description of an embodiment of the invention and with reference to the attached drawings, wherein show:

DETAILED DESCRIPTION OF THE PREERRED EMBODIMENTS

Figure 1:
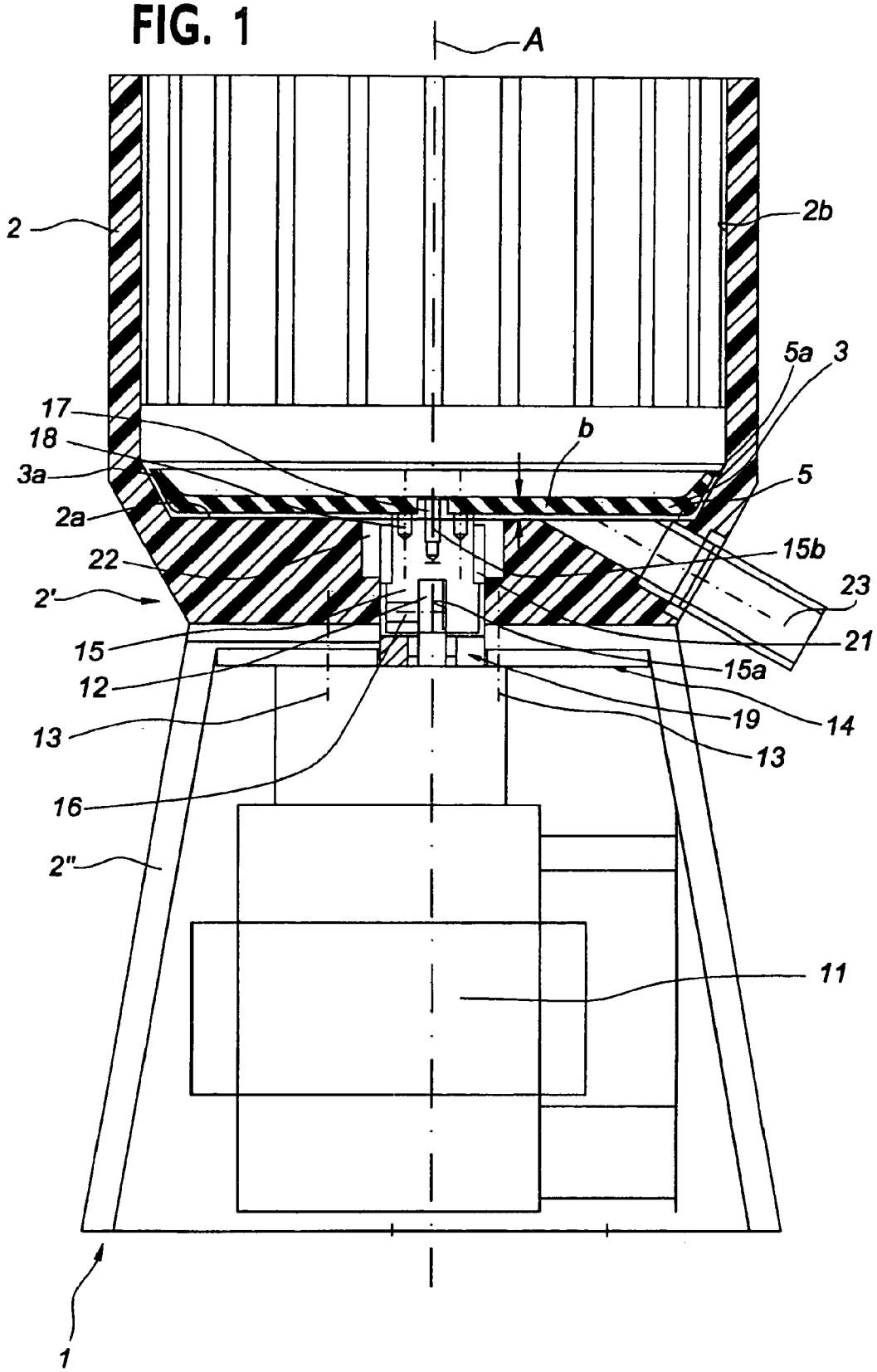
FIG. 1 A preferred development of a device according to the invention.

FIG. 1 shows a preferred development of a device according to the invention, which has a simple construction and which can therefore be manufactured at limited cost and offered for sale at a low price, so that it can also be used in the private sector for polishing private jewellery articles.

The device 1 of FIG. 1 of a centrifugal sliding grinding machine in the form of a disk centrifugal machine has a container 2 with a rotary disk 3.

According to FIG. 1, the device 1 has a one-piece casing 2' with a container 2 and a foot or base 2". The casing 2' is here made from caprolactam, with $NH('CH_2)_5CO$ chains and said material is conventionally also referred to as polyamide 6 or PA6. The container 2 is made from this material. In the container 2 is located a rotary grinding disk 3. The rotary disk 3 is made from flexible material, such as relatively soft plastic or rubber and in particular polyurethane. The grinding material is a polishing grain composite with a central grain of organic material with a wax or fat layer in which the polishing granules are incorporated. The organic material can be natural material, such as walnut shell, cherry stones, wood, coconut shell, etc., as well as a synthetic material such as plastic.

The rotary disk 3 has a circumferential rim 31 which is drawn upwards and which is inclined outwards, whose outer wall follows the contour of the container in this area and is consequently parallel thereto. Thus, between the disk 3 and container bottom 2*a* is formed a finite spacing 5 with a size b of approximately 1.5 mm, which over the entire disk surface has essentially the same size. The disk and/or container 2 can e.g. be vertically adjustably positioned whilst varying the gap width b. As a result of the upwardly drawn disk rim 3*a*, a disk-like receptacle for the grinding article is created. Between the disk rim 3*a* and the container wall 2*b* is formed a gap 5*a*, which is smaller than the spacing 5 and has a width of approximately 0.8 mm.

In the foot 2" below the rotary disk 3 is provided a rotary drive 11 for the latter. The rotary drive can be a motor directly driving the rotary disk 3 or a geared motor with an integrated gear. The rotary drive 11 has a vertically upwardly directed driven shaft 12. The rotary drive 11 is fixed by means of screw connections 13 directed parallel to the shaft 12 and a mounting plate 14 to the casing 2'. A bore of the casing 2' between foot 2*a* and container 2 contains a coupling 15, by means of which the rotary disk 3 is connected in non-rotary manner to the driven shaft 12 of drive 11. For this purpose the coupling 15 has bores 15*a*, 15*b*. Into the bore 15*a* projects the driven shaft 12 of drive 11. A radial clamping bolt 16 is provided for non-rotary connection purposes. Into the bore 15*b* projects a centring pin 17, which is firmly connected to the rotary disk 3. A non-rotary connection between the rotary disk 3 is brought about by screws engaging in the coupling 15 parallel to the centring pin 17.

The axis A of the rotary disk 3 and rotary drive 11 is aligned. The bores 15*a*, 15*b* can also be in the form of a through bore. Below the coupling 15 the driven shaft 16 of the rotary drive 11 is surrounded by a centring ring 19. In the upper area of the coupling, a hardened ring 21 is firmly connected thereto. The coupling 15 is axially retained in the casing 2' by retaining rings 22.

As stated, the rotary disk 3 is spaced from the container bottom 2*a*, accompanied by the formation of a gap 5.

During the operation of the grinding machine the comparatively wide gap makes it possible for small particles of the grinding product or in particular the abrasive to pass between the rotary disk 3 and the container bottom 2*a* and as a result of the rotating, flexible disk they are again passed in the direction of the container wall without there being any significant wear to the container bottom 2*a* or rotary disk 3.

As a result of the flexible rotary disk 3 the generation of frictional heat is largely prevented, in that abrasive particles which get under the rotary disk 3 are not crushed and instead are moved radially outwards. In addition, it is possible to provide laterally in the bottom 2*a* of container 2 a closable outlet 23, which is closed during operation and by means of which any grinding material which has passed below the disk 3 can be removed when the grinding unit has stopped.

Figure 2:
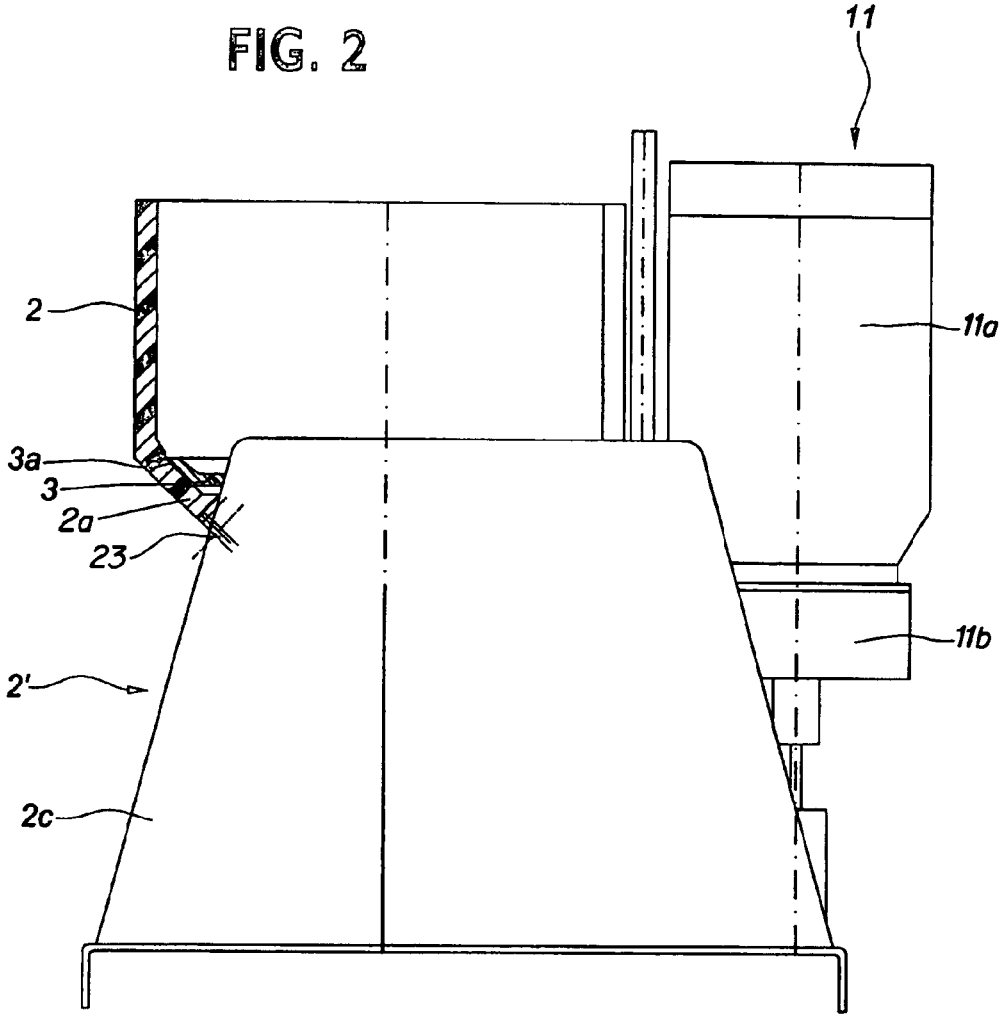
FIG. 2 Another development of a device according to the invention in side view.
Figure 3:
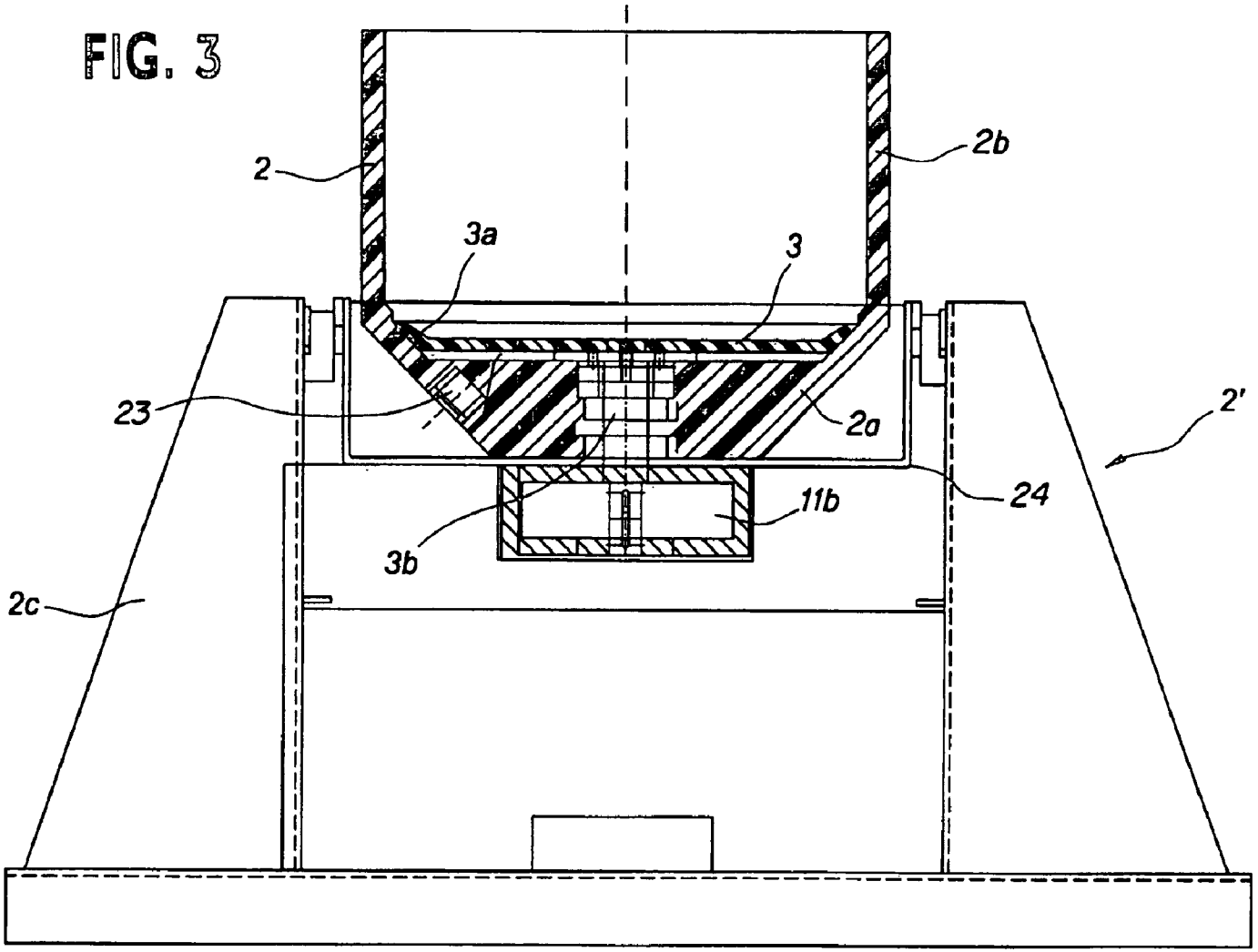
FIG. 3 The essential parts of the device of FIG. 3 (sic) in vertical section.

FIGS. 2 and 3 shows a further development of the invention, in which the grinding machine according to the invention once again has a simple construction and is therefore inexpensive to manufacture.

In this case the casing 2' has a foot 2*c*, which is not constructed in one piece with the container 2. In a manner which has not as yet bean explained the container 2 is fixed to the foot 2*c*. In this case and as is in particular visible in FIG. 2, a motor 11*a* is positioned laterally of the container 2 and the foot 2*c* in such a way that the driven shaft of the motor, which is not itself shown, passes out downwards from the motor 11*a*. The gear 11*b* is also located below the motor 13 and the drive 11 can also be constructed as a geared motor. The top of the motor 11*a* is essentially at the same height as the upper edge of the container 2.

Below the rotary disk 3 in container bottom 2*a* there is once again a closable opening 23, by means of which any grinding material which has passed below the disk 3 can be removed.

FIG. 3 makes it clear that in the foot 2*c* of casing 2 is provided a U-shaped bracket 24, whose leg is fitted to the foot 2*c* of casing 2' and which carries the container 2 with its crosspiece. A drive axis 3*b* for the disk 3 passes through the bottom 2*a* and the crosspiece of the bracket 24 into the gear 11*b*, which extends from its parts immediately below the motor 11*a* to centrally below the container 2, in that corresponding idler gears or other gear designs such as tooth belts, etc. are provided.

Figure 4:
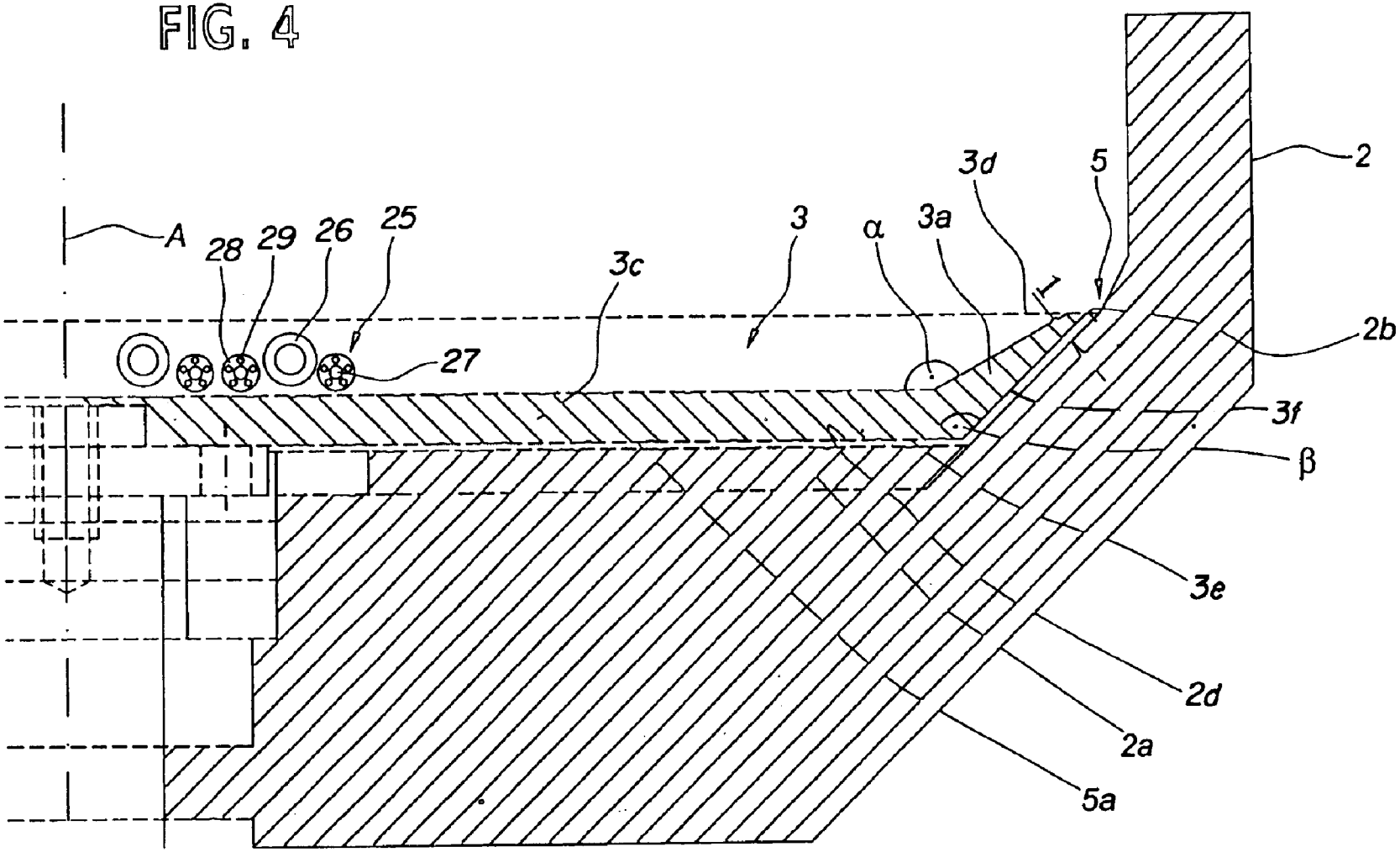
FIG. 4 A larger scale view of the region of the circumferential rim of the rotary disk.

FIG. 4 shows a detail of the upwardly drawn circumferential rim 3*a* of the rotary disk 3 rotatable about axis A in container 2. In the represented embodiment, at least the circumferential rim 3*a* is made from a flexible material with a Shore hardness of 50 to 95°. The rotary disk or its bottom 3*c* can be made from the same or a different material. Additionally or alternatively, in the vicinity of the circumferential rim 3*a*, the container wall 2*b* can be flexible or elastic.

The circumferential rim 3*a* tapers from the bottom area 3*c* of the disk 3 to the free edge 3*d* thereof. The opening angle $\alpha$ of the circumferential rim 3*a* to the bottom 3*c* is approximately 150° in the embodiment shown. The angle $\beta$ between the underside 3*e* of the bottom and the outside 3*f* of the circumferential rim 3*a* is accordingly approximately 130°. The value for both angles $\alpha$, $\beta$ is preferably between 105 and 150°. The inclination 8 of the container inner wall in the vicinity of the rotary disk and therefore the outside of the circumferential rim of the rotary disk 3 in each case to the horizontal is generally between 30 and 70° and is here 65°.

When the rotary disk 3 is unloaded, i.e. when the latter does not rotate and centrifugal forces are not exerted on the circumferential rim 3*a* and the latter, particularly in the edge region 3*d* does not contact the inner wall 2*b* of the container 2, it instead has with respect thereto a finite spacing or gap 5 of at the most preferably 0.4 to 2 mm. Between the underside 3*e* of the rotary disk 3 and the top 2*d* of the bottom 2*a* of container 2, there is also a gap 5*a* or finite spacing.

Figure 5:
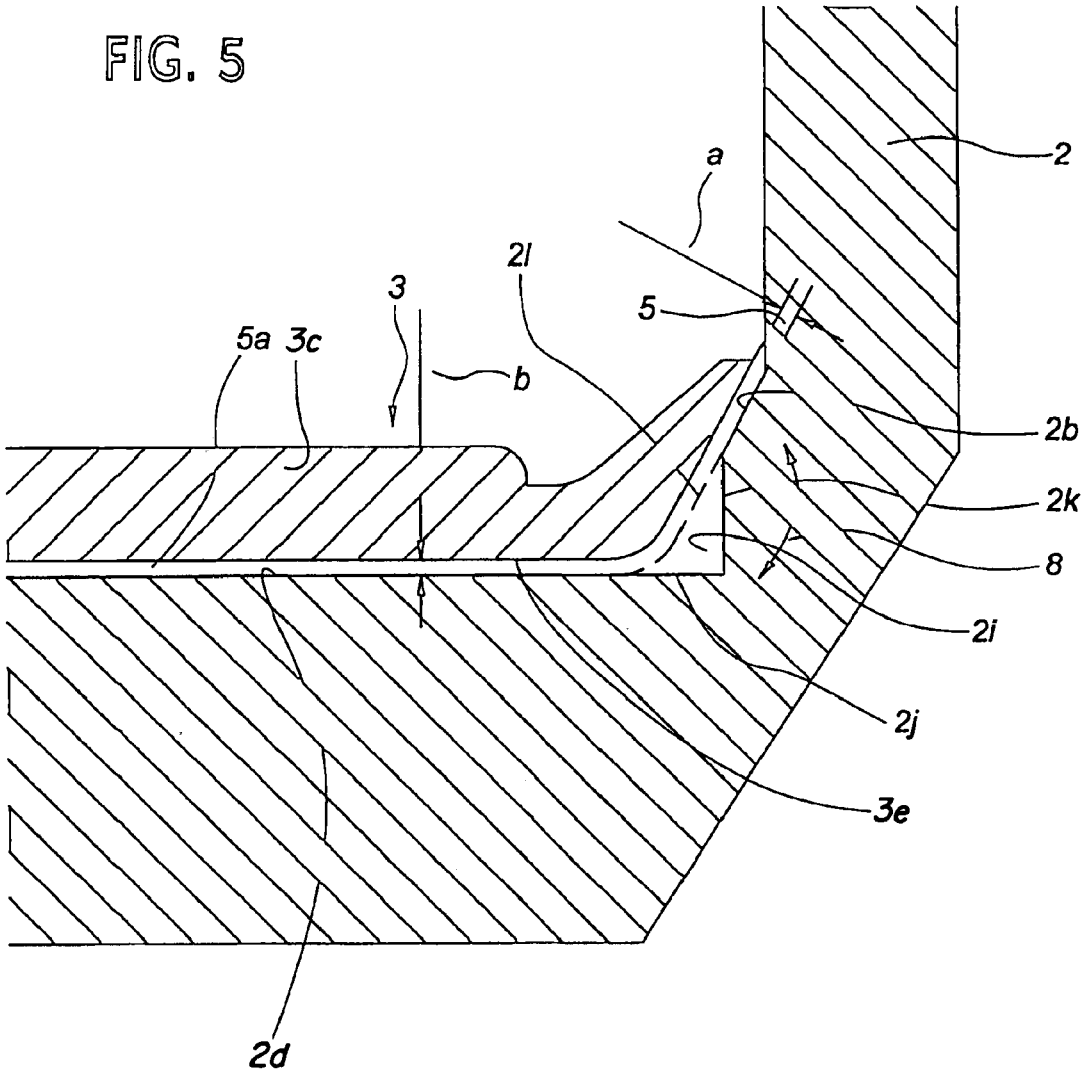
FIG. 5 A larger scale detail of the rotary disk and container of a device according to the invention.

Another preferred development of the invention can be gathered from FIG. 5 showing in detail form parts of the container 2 and rotary disk 3, the reference numerals coinciding with those used hereinbefore. The angle between the inner wall 2*b* of the container in the vicinity of or level with the rotary disk 3 with respect to the angle and which is designated γ is here 55°. Unlike in the previously described embodiments, in the lower region of the inclined wall 2*b* of container 2 there is a recess 2*i*, whose height is roughly determined by the thickness of the bottom 3*c* of the rotary disk 3. The recess 2*i* is bounded by a horizontal bottom area 2*j* and a vertical wall area 2*k*. This recess prevents any pressing of the lower, radially less flexible area of the bottom 3*c* pressing against the wall 2*b* of the container 2 as a result of thermal expansion of the disk 3, so as to bring about in operation a significant heat generation and wear. If the upper edge region of the lip of the raised rim or the lip of the rotary disk contacts the wall 2, as a result of the flexibility of the raised rim this causes no problems, because as a result of the organic nature of the abrasive material used, an antifriction layer of the sane material and wax surrounding the corresponding grains is provided, so as to exert a friction-reducing action. In the vicinity of the recess 2*i* abrasive material (organic material such as walnut particles and embedding wax) collects and extends roughly up to the broken line 21 shown.

Workpieces and abrasive agents are shown in small numbers in exemplified manner and for machining the container of FIG. 1 is filled to a significant extent with an abrasive (at least one third filled). As shown in FIG. 4, abrasive 25 for grinding the workpieces 26, such as e.g. jewellery rings, is a composite abrasive based on walnut granules having a central walnut grain 27, which is externally surrounded by a fat or wax layer 28, in which are incorporated abrasive polishing grains 29, particularly of silicate or oxide.

When the disk grinding machine 1 according to the invention is in operation, the free edge 3*d* of the circumferential rim 3*a* of the abrasive disk 3 is pressed by centrifugal force and the abrasive material 25 and grinding article (workpieces) 26 filled into the container against the wall 2*b* of said container 2, so that entry of walnut abrasive into gaps 5, 6 is largely prevented.

During machining the polishing grains become worn, so that dust and abrasive particles occur and in addition resinified wax and fat constitutes also form dust. Such dust and abrasive particles which are smaller than the actual abrasive agent 25 are able to pass between the disk rim 3*a* and the container wall 2*b* and pass below the container and as a result of the flexibility of the circumferential rim 3*a* (and optionally to a lesser extent the wall 2*b*), due to the centrifugal forces acting thereon due to the rotary disk movement, they are again in part forced through the marginal gap 5*a* into the machining chamber. In part they can be removed through an outlet in the container bottom.

It has been found that the material combination polyamide 6 for the container, or at least the inside of the container, and polyurethane for the actual container is of an optimum nature, particularly in conjunction with the aforementioned abrasive. There is no wear to the container wall. As a result of this choice of material, fusing between the rotating disk and container wall in the case of contacts caused by centrifugal forces is prevented. This would occur through the heating caused by friction if e.g. the disk and container bottom were made from the same plastics material. In addition, the self-cleaning effect is significantly improved.

During the operation of the disk grinding machine according to the invention, particularly in the case of a dry process, the free edge 3*c* of the circumferential rim 3*a* is pressed by centrifugal force and the abrasive material and grinding product filled into the container against the wall 2*b* of said container 2, so that entry of abrasive material into gaps 5, 6 is largely prevented. However, as a result of the flexibility of in particular the circumferential rim 3*a* (or also the wall 2*b*), the abrasive grains can be forced out of the gap again through the centrifugal forces acting thereon due to the rotary disk movement. Despite the contact between the circumferential rim 3*a* and the container wall 2*b*, there is surprisingly no excessive heating of the disk and in particular the circumferential rim 3*a*, which is normally made from PU, and in particular no fusing with the circumferential wall as a result of heating. This may be due to the fact that as a result of the abrasive powder or dust formed enters the gap 5 between the circumferential rim 3*a*, particularly in the vicinity of edge 3*d* and container wall 2*a* and exerts a lubricating action there.

What is claimed is:

1. Device for the dry grinding or polishing of workpieces by means of an abrasive, having a container and a rotary disk located therein and rotatable relative thereto, which is positioned with a finite spacing from the bottom of the container and which has an upwardly drawn disk rim, which as a result of construction has a finite spacing from the adjacent inner wall of the container, wherein the rotary disk is substantially planar and is positioned parallel to the top of the bottom of the container, wherein the spacings of the rotary disk from the bottom and wall of container are substantially of the same order of magnitude, and wherein in the transition area from the bottom of the container to its wall is formed a recess such that the spacing between the container wall and the disk is locally increased.

2. Device according to claim 1, wherein an outside surface of the disk rim has an inclination of less than 90° to the horizontal.

3. Device according to claim 2, wherein the inclination to the the outside surface of the disk rim has an inclination between 30 and 70° to the horizontal.

4. Device according to claim 1, wherein an outside of the disk rim and the inner wall of the container are substantially parallel to one another.

5. Device according to claim 1, wherein the finite spacing or gap at an upper, outer edge of the disk rim with respect to the container inner wall is between approximately 2 and 10% of the diameter of the disk.

6. Device according to claim 1, wherein the finite spacing or gap at an upper, outer edge of the disk rim of the container inner wall is between approximately 0.4 and 2 mm of the diameter of the disk.

7. Device according to claim 1, wherein, the disk rim tapers towards its upper, free edge.

8. Device according to claim 1, wherein the disk bottom is made from elastic material.

9. Device according to claim 1, wherein the free spacing between the disk rim and the adjacent inner wall of the container is smaller than a vertical spacing between the underside of the disk bottom and the top of the container bottom.

10. Device according to claim 1, wherein the bottom of the rotary disk substantially has a constant thickness.

11. Device according to claim 1, wherein the disk rim has a smaller thickness than the disk bottom.

12. Device according to claim 1, wherein the outer circumference (towards the raised disk rim) of the disk bottom is tapered.

13. Device according to claim 1, wherein the thickness of the disk bottom is between approximately 2 and 8% of its diameter.

14. Device according to claim 1, wherein the thickness of the rotary disk is between approximately 5 and 10 mm.

15. Device according to claim 1, wherein the increased spacing in the transition area from the bottom of the container to its wall is formed by a notch in the path of the container wall to the container bottom.

16. Device according to claim 1, wherein the rotary disk is made from plastic, particularly polyurethane.

17. Device according to claim 1, wherein at least the inside of the container and preferably the entire container is made from plastic, preferably polyamide 6 (PA6) or polyamide 66.

18. Device according to claim 16, wherein the flexible areas of the disk, particularly the disk rim is made or lined with material having Shore hard nesses from 50 to 95°.

19. Device according to claim 17, wherein at least the inner wall of the container.

20. Grinding system comprising the device for the dry grinding or polishing of workpieces by means of an abrasive according to claim 1, and an abrasive with organic grain provided in the container.

21. Grinding system according to claim 20, wherein the abrasive grain comprises natural, organic material.

22. Grinding system according to claim 21, wherein the abrasive grain comprises synthetic-organic material.

23. Grinding system according to claim 21, wherein the abrasive is a composite abrasive with a central, organic material grain, which is surrounded by a binder layer containing polishing particles.

24. Grinding system according to claim 21, wherein the abrasive has a grain size between 500 and 50.

25. Grinding system according to claim 21, wherein the abrasive grain comprises a material selected from the group consisting of walnut shell, coconut shell, wood and cherry stones.

26. Grinding system according to claim 22, wherein the abrasive grain comprises plastic.

27. Device according to claim 19, wherein the entire container is made of polycaprolactam.

* * * * *